US005152020A

United States Patent [19]

Sobie

[11] Patent Number: 5,152,020

[45] Date of Patent: Oct. 6, 1992

[54] WATERBED MATTRESS HAVING IMPROVED ANCHORING OF FLOATING INSERTS

[76] Inventor: Robert A. Sobie, 6026 -187-A St., Surrey, B.C., V3S-7R6, Canada

[21] Appl. No.: 840,335

[22] Filed: Feb. 24, 1992

[30] Foreign Application Priority Data

Apr. 12, 1991 [CA] Canada ..... 2040310

[51] Int. Cl.[5] ..... A47C 27/08

[52] U.S. Cl. ..... 5/451; 5/919; 5/921; 5/932; 156/300

[58] Field of Search ..... 5/451, 450, 449, 452, 5/457, 458, 931, 932; 156/300

[56] References Cited

U.S. PATENT DOCUMENTS 4,192,031 3/1980 Fogel ..... 5/451
4,247,962 2/1981 Hall ..... 5/450
4,280,235 7/1981 Kowal ..... 5/451
4,328,599 5/1982 Mollura ..... 5/451
5,062,170 11/1991 Tohenning ..... 5/451

FOREIGN PATENT DOCUMENTS 1100238 4/1981 Canada .

*Primary Examiner*—Alexander Grosz
*Attorney, Agent, or Firm*—Baker, Maxham, Jester & Meador

[57] ABSTRACT

According to the present invention, an improved method of anchoring floating waterbed mattress inserts is provided. A vinyl tether is provided which is secured at one end thereof to the floating insert. The other end of the tether is welded to a section of fibre mat which in turn is welded to the bottom of the mattress.

19 Claims, 2 Drawing Sheets

WATERBED MATTRESS HAVING IMPROVED ANCHORING OF FLOATING INSERTS

FIELD OF THE INVENTION

The invention relates to the field of waterbed mattress construction, with particular reference to waterbed mattresses having floating inserts.

BACKGROUND OF THE INVENTION

One of the problems encountered in conventional waterbed design is the presence of wave motion within the waterbed mattress. A conventional waterbed comprises a water retaining bladder, generally vinyl, supported along its sides by a rigid frame. Where there is no provision for damping of wave motion within the mattress, movement of a person on the water-retaining bladder will generate waves within the bladder which reflect off the sides of the frame causing standing waves within the bladder at a resonant frequency depending on the volume of the bladder. This wave action is disturbing to the individual sleeping on the mattress.

Consequently, various means for damping the wave action have been attempted. One common approach is to provide floating inserts of one form or another within the mattress to dampen wave motion. These may be floating baffles, plastic foam sheets or a floating mat of non-woven polyester fibre which is fixed with acrylic binder. A typical example of such a floating fibre mat is formed of 45 denier non-woven polyester fibres bound together with acrylic resin, with the fibres oriented both horizontally and vertically prior to binding. Such a fibre mat is sufficiently porous that water can flow through it.

It is desirable to anchor such floating structures to the bottom of the mattress. Otherwise the inserts can shift, fold or ball up when the mattress is emptied, moved or even during normal use. Previously such anchoring has been accomplished simply by attaching one end of a vinyl tether to the insert and welding the other end of the vinyl tether directly to the bottom of the mattress. This shortens the life of the mattress since it places added strain on the seams of the mattress and eventually a leak will be created in the mattress.

There is therefore a need for a means of anchoring floating waterbed mattress inserts which reduces the problem of stress on the seams of the mattress.

SUMMARY OF THE INVENTION

According to the present invention, an improved method of anchoring floating waterbed mattress inserts is provided. A vinyl tether is provided which is secured at one end thereof to the floating insert. The other end of the tether is welded to a section of fibre mat which in turn is welded to the bottom of the mattress.

BRIEF DESCRIPTION OF THE DRAWINGS

In drawings which illustrate a preferred embodiment of the invention.

DETAILED DESCRIPTION OF THE PREFERRED EMBODIMENT

Figure 1:
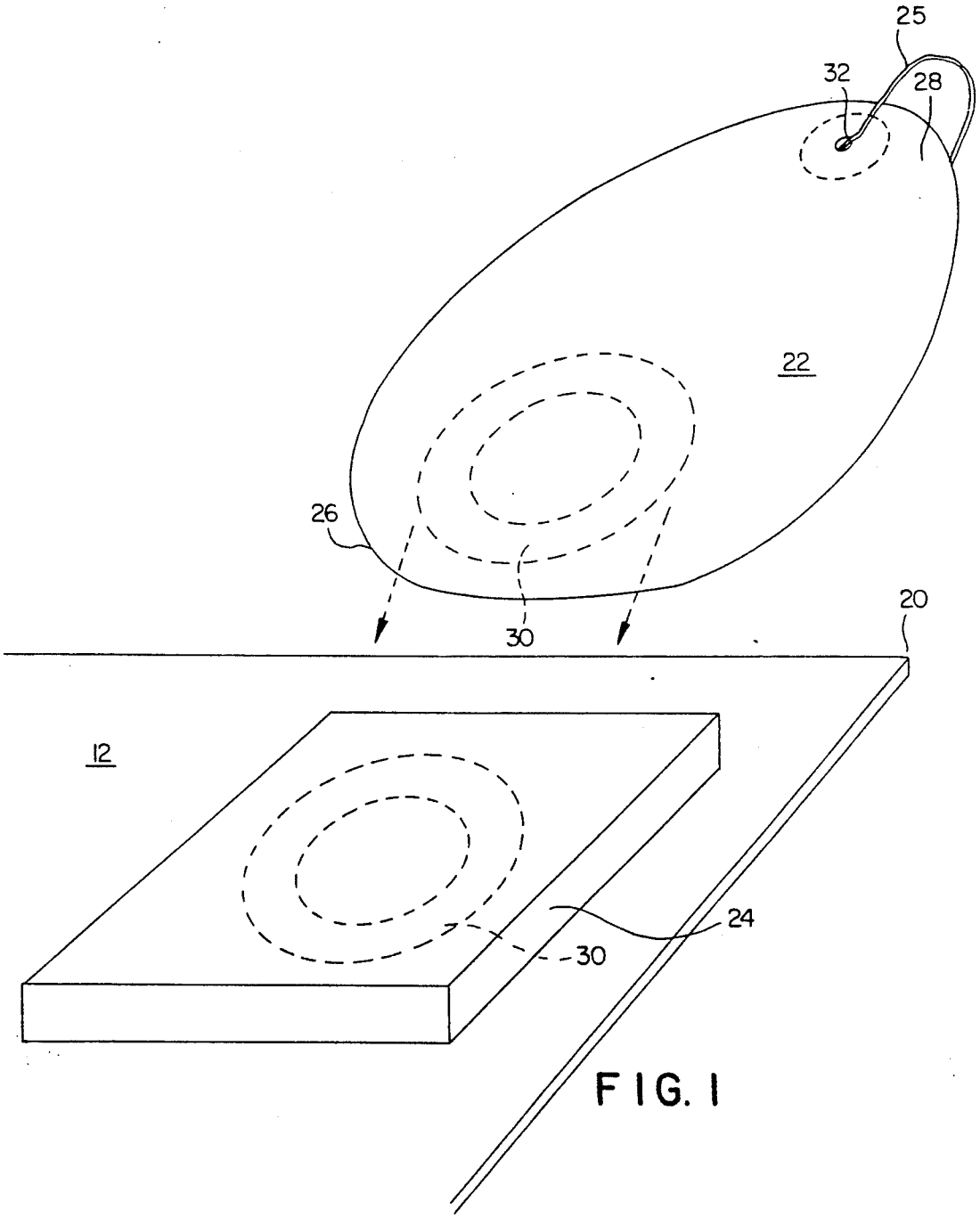
FIG. 1 is a perspective view illustrating a corner of a waterbed mattress cut away to show the bottom of the mattress and the anchoring method of the invention.
Figure 2:
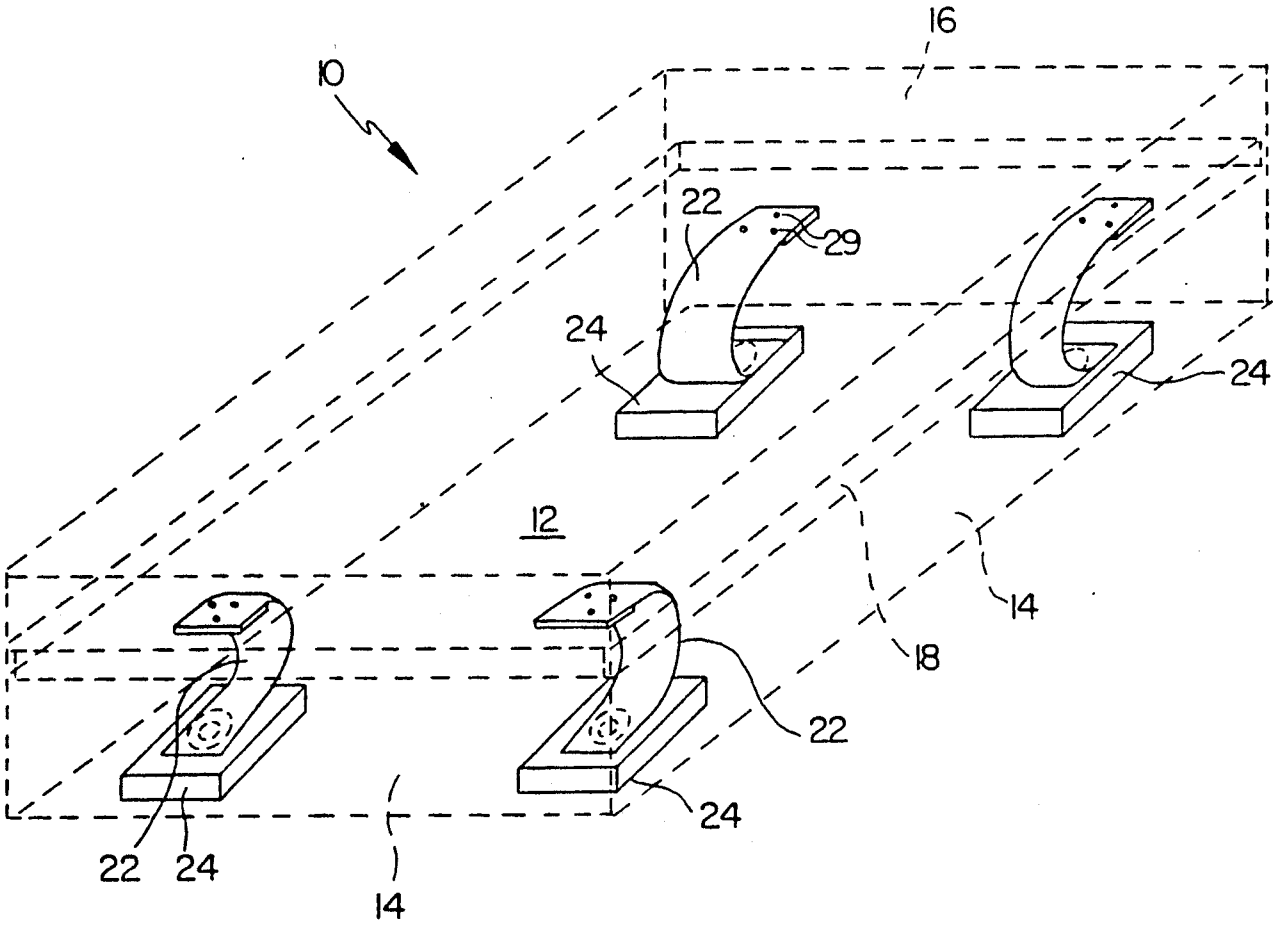
FIG. 2 is a perspective view of a waterbed mattress provided with a floating fibre mat, both shown in dotted outline, with the fibre mat anchored according to the invention.

With reference to FIG. 2 of the drawings, a waterbed mattress 10, shown in dotted outline filled with water, is a watertight bladder consisting of bottom 12, side walls 14 and top 16, generally constructed of vinyl (polyvinylchloride) which is 0.02 inches ("20 mill") in thickness and which is heat welded at the seams. It is provided with a wave-damping floating fibre mat 18 which is anchored according to a preferred embodiment of the invention. In FIG. 1 the side walls and top of the mattress are removed for purposes of illustration. The corner of the mattress is shown at 12.

Adjacent each corner of the mattress, a pad 24 of fibre material as described above for use in a floating insert (non-woven polyester fibres bound together with acrylic resin) is provided. Preferably the pad is between ¾-inches and one-inch in thickness and about 5 inches in length and width. An elongated piece of vinyl 22, of approximately the same thickness as the waterbed material, is provided. One end 26 of vinyl piece 22 is heat welded to the bottom 12 of the waterbed through the fibre pad 24. Preferably an annular-shaped weld 30 with an inner diameter of about 2¼ inches and outer diameter of about 3½ inches is used. Preferably the welding of pad 24 to piece 22 and surface 12 is done as a single welding step with the pad 24 sandwiched between the vinyl pieces 22 and 12. The result of such heat welding is that each piece of vinyl 12 and 22 is fused to the polyester pad 24, but the two pieces of vinyl are not fused together.

As shown in FIG. 2, to secure piece 22 to the floating insert, the second end 28 of piece 22 can be doubled over and rivetted to the fibre mat by rivets 29 or similar fastening means. According to a second embodiment, adjacent the other end 28 of piece 22 is provided a hole 32 (shown in FIG. 1) which is preferably reinforced. A tie line, 25 whether of synthetic or natural material of sufficient strength and resistance to deterioration, is then secured through hole 32 and looped through the floating fibre insert or other floating insert to secure it to the anchor. As shown in FIG. 2, where the insert is a fibre mat, four anchors as described above will be provided at each corner of the mattress, although different arrangements may be used for other types of inserts.

An anchor constructed in this way has a number of advantages. Since the vinyl anchor piece 22 is not welded directly to the bottom of the mattress, but rather to the fibre pad 24, if large stresses are applied to the anchor, the fibre pad will tear apart, preventing tearing of the waterbed mattress It has been found that about 70 pounds pressure will cause the fibre pad to tear. Secondly, the fibre pad permits some motion under stress as between the bottom of the waterbed 12 and vinyl anchor piece 22, which motion is absorbed in the separation of fibres in the pad 24. This cushioning effect reduces the direct stress on the seams of the waterbed, prolonging its life.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of anchoring floating inserts to the bottom of a waterbed mattress comprising:

a) providing an elongated piece of flexible water-resistant material having first and second ends and adapted at said first end thereof to be secured to said floating insert;

b) providing a pad of fibrous material between said bottom of said waterbed mattress and said second end of said flexible piece;

c) securing said bottom of said waterbed to said fibrous pad and said fibrous pad to said flexible piece; and d) securing said floating insert to said first end of said flexible piece.

2. The method of claim 1 wherein said flexible material is a plastic or vinyl capable of heat welding, and said piece of material is secured to said fibrous pad by heat welding.

3. The method of claim 2 wherein said fibrous pad is secured to said bottom of said waterbed mattress by heat welding.

4. The method of claim 3 wherein said heat welding of said bottom of said waterbed to said fibrous pad and of said fibrous pad to said flexible piece are done simultaneously.

5. The method of claim 4 wherein said waterbed mattress is vinyl.

6. The method of claim 1 wherein said fibrous pad comprises polyester fibres.

7. The method of claim 1 wherein said fibrous pad comprises unwoven polyester fibres.

8. The method of claim 1 wherein said fibrous pad comprises bonded unwoven polyester fibres.

9. The method of claim 1 wherein said fibrous pad comprises unwoven polyester fibres bonded with resin.

10. A waterbed mattress comprising a floating insert and means for anchoring said insert to the bottom of said waterbed mattress, said anchoring means comprising:

a) an elongated piece of water-resistant flexible material having first and second ends and adapted at said first end thereof to be secured to said floating insert: and b) a pad of fibrous material between said bottom of said waterbed mattress and said second end of said flexible piece wherein said bottom of said waterbed is secured to said fibrous pad and said fibrous pad is secured to said flexible piece; and c) means securing said floating insert to said first end of said flexible piece.

11. The waterbed mattress of claim 10 wherein said flexible material is a plastic or vinyl capable of heat welding, and said flexible piece of material is secured to said fibrous pad by heat welding.

12. The waterbed mattress of claim 11 wherein said fibrous pad is secured to said bottom of said waterbed mattress by heat welding.

13. The waterbed mattress of claim 12 wherein said heat welding of said bottom of said waterbed to said fibrous pad and of said fibrous pad to said vinyl piece comprise a single heat weld.

14. The waterbed mattress of claim 10 wherein said fibrous pad comprises polyester fibres.

15. The waterbed mattress of claim 10 wherein said fibrous pad comprises unwoven polyester fibres.

16. The waterbed mattress of claim 10 wherein said fibrous pad comprises bonded unwoven polyester fibres.

17. The waterbed mattress of claim 10 wherein said fibrous pad comprises unwoven polyester fibres bonded with resin.

18. The waterbed mattress of claim 10 wherein said means for securing said flexible piece to said insert comprises rivet means.

19. The waterbed mattress of claim 10 wherein said flexible piece comprises an aperture adjacent said first end thereof and said means for securing to said insert comprises an elongated line having an end for securing in said aperture and an end for securing to said insert.

* * * * *